United States Patent [19]

Laber

[11] 4,182,408

[45] Jan. 8, 1980

[54] MULTILAYERED TUBE SHEET ASSEMBLY FOR HEAT EXCHANGERS

[75] Inventor: Walter Laber, Deggendorf, Fed. Rep. of Germany

[73] Assignee: Deggendorfer Werft und Eisenbau GmbH, Deggendorf, Fed. Rep. of Germany

[21] Appl. No.: 882,183

[22] Filed: Feb. 28, 1978

[30] Foreign Application Priority Data

Mar. 1, 1977 [DE] Fed. Rep. of Germany ..... 2708696

[51] Int. Cl.[2] ..... F28F 9/16

[52] U.S. Cl. ..... 165/70; 29/157.4; 29/523; 165/76; 165/134 R; 165/173; 228/183; 285/13; 285/222; 285/286

[58] Field of Search ..... 165/70, 134, 173, 175, 165/76, 11; 29/157.4, 523; 285/137 R, 13, 189, 222, 286; 228/183

[56] References Cited

U.S. PATENT DOCUMENTS

| | | | |
|---|---|---|---|
| 2,743,089 | 4/1956 | Gardner et al. | 165/134 |
| 2,915,295 | 12/1959 | Boni, Jr. | 165/70 |
| 3,114,415 | 12/1963 | Wintzer | 165/134 |

FOREIGN PATENT DOCUMENTS

| | | | |
|---|---|---|---|
| 574386 | 4/1959 | Canada | 165/70 |
| 684736 | 12/1939 | Fed. Rep. of Germany | 165/11 |
| 2122179 | 11/1972 | Fed. Rep. of Germany | 29/157.4 |
| 860139 | 2/1961 | United Kingdom | 165/70 |

*Primary Examiner*—Sheldon Richter

*Attorney, Agent, or Firm*—Toren, McGeady and Stanger

[57] ABSTRACT

A tube sheet construction for heat exchangers, particularly those of the type which utilize immiscible fluid heat exchange media, is formed with a tube sheet base plate and with a plurality of heat exchange tubes extending along at least a portion of their lengths in sealed fluid-tight engagement through the tube sheet base plate. The base plate is provided with a series of internal ducts extending in flow communication with the exterior of the tubes at the portion of the length thereof in sealed engagement with the base plate. The ducts are in flow communication with the exterior of the base plate and permit leaking fluid heat exchange media to be detected and exhausted from the heat exchanger. The tube ends extend beyond the base plate and a tube sheet cover plate extends over the base plate and is rigidly connected thereto with the cover plate having the projecting ends of the tubes fixed thereto by welding or the like. A plurality of cover plates may be provided and leakage ducts extending along a plurality of planar levels may also be provided.

10 Claims, 8 Drawing Figures

MULTILAYERED TUBE SHEET ASSEMBLY FOR HEAT EXCHANGERS

BACKGROUND OF THE INVENTION

The present invention relates generally to heat exchangers and more particularly to heat exchangers of the type wherein special care must be taken that the heat exchange media utilized will not come into contact with each other. More specifically, the invention is directed toward the structure of the tube sheet assembly for such heat exchangers.

In heat exchangers which must utilize immiscible fluid heat exchange media which for certain reasons will cause severe problems if they come in contact with each other, special care must be exhibited to avoid mixing or intermingling of the heat exchange media. Otherwise, vigorous explosive reactions may occur or mixing of the media may result in serious or heavy corrosion to parts of the heat exchangers.

Accordingly, measures are usually provided to avoid leakages which will mostly occur in the region of points of joinder between various parts of the heat exchanger.

Conditions such as those suggested above exist especially in tube-reactors which perform catalytic reactions.

Additionally, the coefficient of heat transfer may be lowered because of wide spacing of tubes which may be provided for safety reasons. The wide spacing of the tubes may become uneconomical and may, in addition, have an adverse effect on space requirements because of the larger dimensions of the heat exchanger.

Furthermore, in designs of the type discussed, two tube sheets are provided which may assume different temperature levels inasmuch as an inner tube sheet may assume the temperature of the medium surrounding the tubes while the outer tube sheet may assume the temperature of the medium flowing through the tubes and, thus, approximate the temperature of the tubes. This will result in unequal heat expansion of the two tube sheets and, therefore, will cause relative transverse movement of the tubes in the tube sheet planes.

In the prior art, there are known tube sheet constructions wherein several tube sheet plates are arranged to lie immediately adjacent each other with the plates being rigidly connected with each other.

Furthermore, in attaching the tubes of the heat exchanger with the tube sheets, a rolling technique involving rolling of the tubes into the tube sheet has been utilized and as a result a rather strong but not always absolutely leak proof joint may be achieved.

A further problem may arise because of the desirability of controlling and accumulating any leakage liquid which may be produced in order to avoid further problems. Toward this end, an arrangement of grooves or ducts may be provided, with the grooves or ducts being connected with the tube sheet at a point located adjacent the exterior of each tube.

The invention is particularly directed toward providing a structure for a heat exchanger wherein problems may arise due to leakage of the fluid heat exchange media by arranging the construction of the tube sheets such that an advantageous approach may be taken with regard to any leakage that may occur.

SUMMARY OF THE INVENTION

Briefly, the present invention may be described as an assembly for a multilayered tube sheet construction for heat exchangers, particularly those which utilize immiscible fluid heat exchange media, the assembly of the tube sheet comprising a tube sheet base plate, a plurality of heat exchange tubes extending along at least a portion of their length in sealed fluid-tight engagement through the tube sheet base plate, means defining within the base plate a series of internal ducts extending in flow communication with the exterior of the tubes at the portion of the length of the tubes in sealed engagement with the base plate, and a tube sheet cover plate extending over the tube sheet base plate and being rigidly connected thereto. The ducts are in flow communication with the exterior of the base plate and thus permit leaked heat exchange media to flow out of the interior of the heat exchanger and be collected or otherwise detected. The tubes extend at their ends beyond the base plate and the cover plate has the projecting ends of the tubes fixedly joined thereto, as by welding or the like.

Thus, a system of internal ducts is provided in the tube sheet assembly adjacent points where joinders or connections must be made and where leakage is most likely to occur, with the duct system operating to enhance the ability of the exchanger to cope with leakage phenomena.

Thus, it will be seen that the main purpose of the invention is to solve the problem of leak-proofing a heat exchanger and simultaneously providing a sufficient fastening effect for the tubes in multilayered tube sheet assemblies as well as enabling the assembly to cope with leakage at other locations. To this end, the invention involves connecting the tubes with the tube sheet base plate by a rolling-in process which is effected a small distance from the end of the tube, and by welding the tube by a welding seam with the tube sheet cover plate at the end of the tubes. Transverse ducts are connected to a system which permits the ducts to be placed in flow communication with the exterior of the heat exchanger with each duct being connected to, for example, an annular groove which surrounds the rolled-in portion of the tube located along that part of the tube length where the tube is attached to the base plate.

In accordance with another feature of the invention, in addition to the tube sheet base plate, a pair of tube sheet cover plates may be provided wherein the tubes are also connected by a rolling-in process with the tube sheet cover plate immediately adjacent to the tube sheet base plate and wherein in the region of the rolled-in section of the tubes, the tubes are each surrounded by annular grooves with the grooves being connected in groups through transverse ducts to a special duct system leading to the exterior of the device.

In the construction of the present invention, the tube sheet cover plate may be produced by a welding process where the cover plate is built up in layers over the base plate. The duct system would in such an arrangement be formed in the base plate and thus have one side open before the cover plate is applied. Thus, it is recommended that rods be placed in the ducts prior to formation of the cover plate in order to protect the ducts as the cover plate is being formed by the built-up welding process.

Finally, it is considered advantageous if the transverse ducts in the tube sheet base plate and the tube sheet cover plate in the middle are connected to separate outlet bores and outlet pipe connections.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
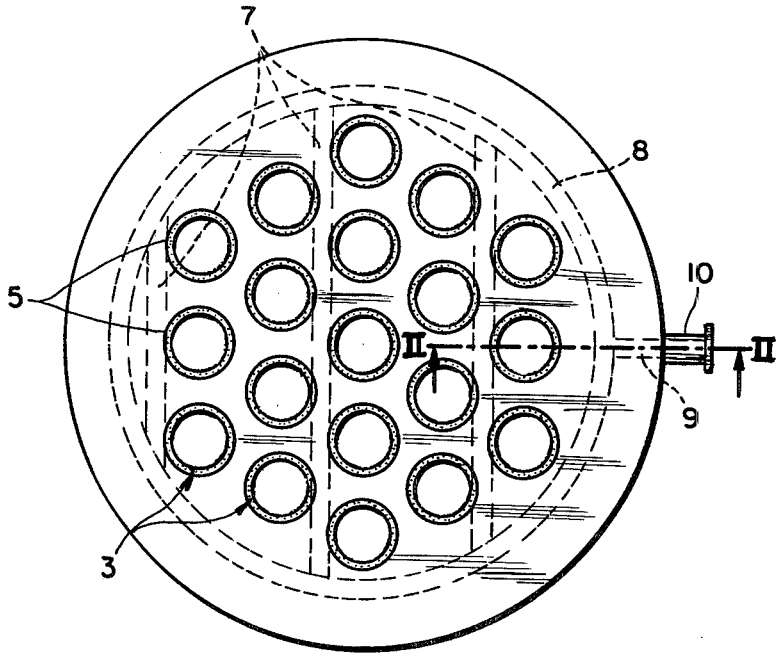
FIG. 1 is a top view of a tube sheet assembly in accordance with the present invention.
Figure 2:
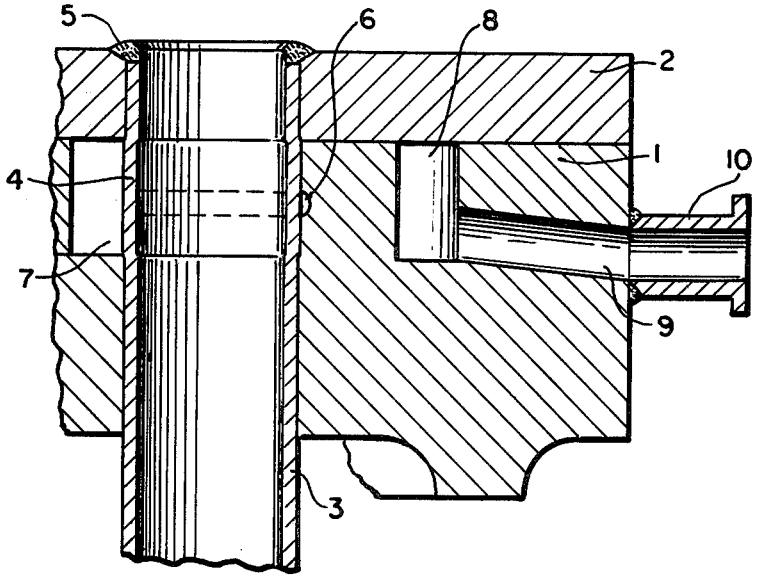
FIG. 2 is a vertical partial sectional view taken along line II—II of FIG. 1.

Referring first to the embodiment depicted in FIGS. 1 and 2, there is shown a tube sheet assembly wherein at the outer surface of a tube sheet base plate 1 there is formed a tube sheet cover plate 2 which is applied by spray deposition or vacuum deposition. Of course, it will be noted that electroplating or plating by means of vacuum or other approaches may be utilized in forming the cover plate 2. The tube sheet base plate 1 forms the boundary of the interior space of a heat exchanger. A plurality of tubes 3 extend in sealed connection with the base plate 1 at a rolled section 4 of the tubes 3. The tubes 3 extend beyond the rolled section 4 and project from base plate 1. At the projecting portions of the tubes 3 they are in engagement with the cover plate 2 and are attached by a welding seam 5.

Additionally, the base plate 1 is formed to comprise an annular groove 6 which extends in the region of each tube where the rolled section 4 is formed. Furthermore, several parallel horizontally extending transverse ducts 7 are provided which are interconnected with one group of annular grooves 6 each and which open at their ends into an annular duct 8 (FIG. 1). The transverse ducts 7 and the annular duct 8 are advantageously cut at the outer front surface into the base plate 1 so that the cover plate 2 will form a boundary of these ducts.

From the annular duct 8 a bore 9 leads laterally to the exterior and to a connection 10 which comprises an outlet pipe and which is welded to the outside surface.

Figure 3:
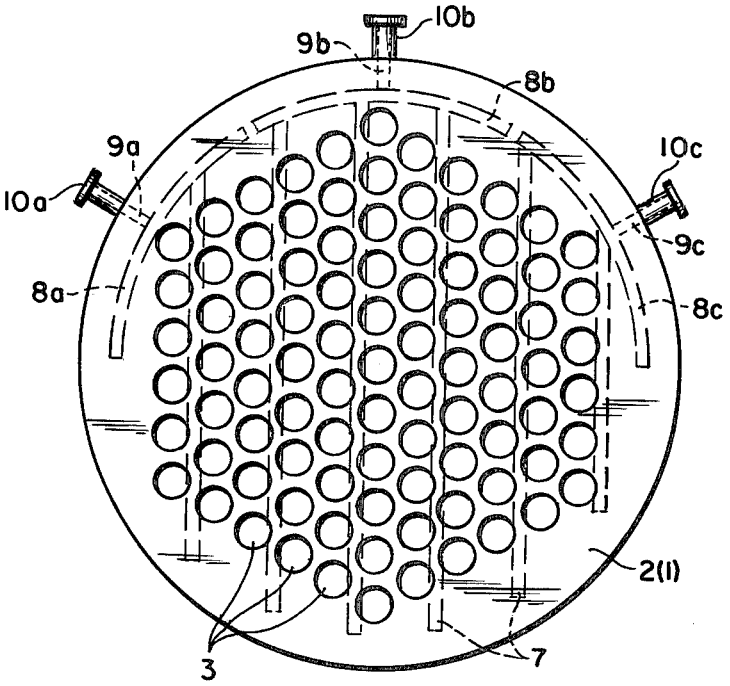
FIGS. 3 and 4 are top views of tube sheet assemblies each having differently constructed duct systems.

In the tube sheet according to FIG. 3, which also consists of a base plate 1 and a cover plate 2 formed on the top of the base plate 1 and of tubes 3 attached to both plates according to FIG. 2, the transverse ducts 7 are with one end connected to three annular duct sections 8*a*, 8*b*, 8*c* which are separated from each other. From each of these annular duct sections, a bore 9*a*, 9*b*, 9*c*, respectively, leads laterally to the exterior and to an outlet pipe connection 10*a*, 10*b*, 10, respectively, welded to the outer surface.

Figure 4:
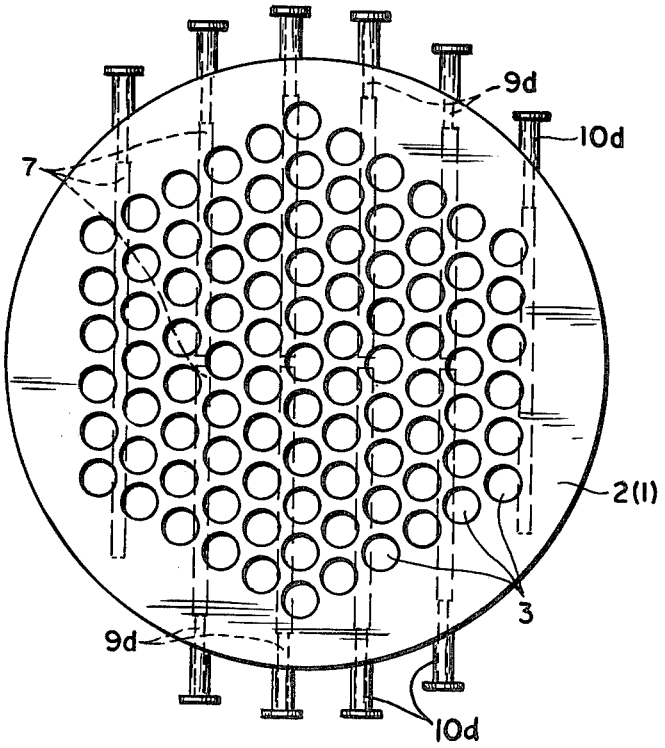

In the tube sheet assembly according to FIG. 4, which also consists of a base plate 1 and a cover plate 2 located on top of the base plate 1 and of tubes 3 attached to both plates according to FIG. 2, the transverse ducts 7 are connected to bores 9*d* partially at one end and partially with both ends and lead laterally to the exterior and to outlet pipe connections 10*d* welded to the outer surface.

Figure 5:
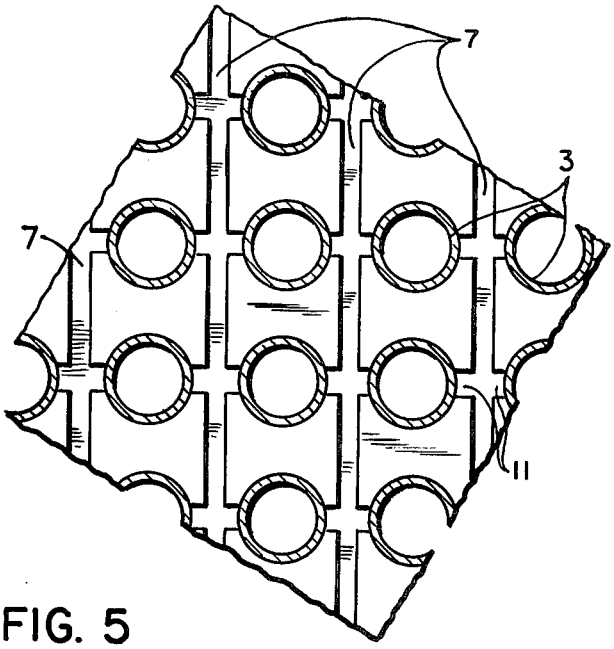
FIGS. 5 and 6 are horizontal partial sectional views of further variations of the duct system.
Figure 7:
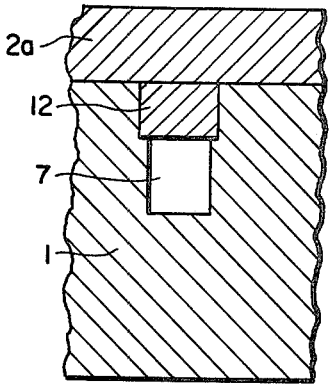
FIG. 7 is a vertical partial sectional view taken through still another embodiment of a tube sheet assembly.
Figure 6:
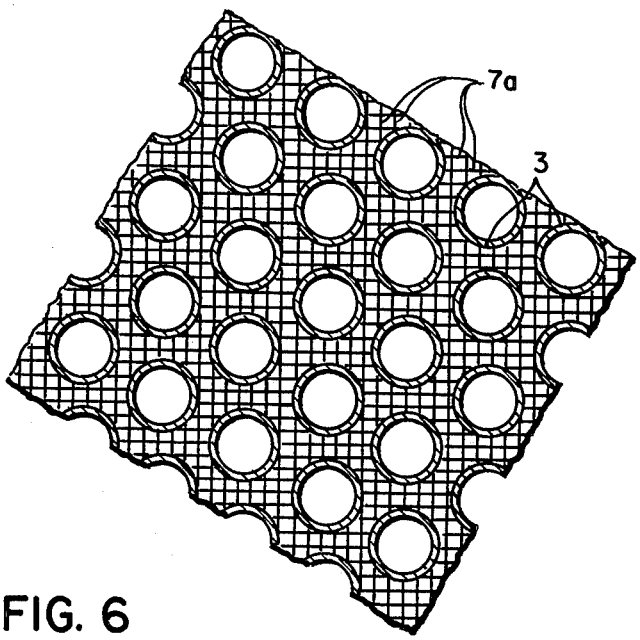

FIGS. 5–7 show other embodiments of the transverse duct system in accordance with the invention. According to FIG. 5, tubes 3 are arranged in rows which are not staggered. Therefore, the tubes have a somewhat larger spacing so that the transverse ducts 7 will not be in immediate flow connection with the annular grooves 6 of neighboring tube rows. Therefore, short branch ducts 11 are arranged at respective locations.

FIG. 6 shows an entire system of transverse ducts 7*a* which are arranged in a crosswise manner. By comparision, these ducts are narrower and also have a smaller distance between each other. In this case, each annular groove 6 is connected to several transverse ducts 7*a* in the region of individual tubes 3. The positions of the tubes 3 and their spacing may be optionally selected. The transverse ducts 7*a* advantageously open into an annular duct 8 (not shown) in accordance with the embodiment depicted in FIGS. 1 and 2.

According to FIG. 7, a transverse duct 7 is sealingly covered by a seal or rod 12 toward the outer front surface of the base plate 1. A similar arrangement is provided for all of the other transverse ducts in the base plate. This measure is necessary if the cover plate 2*a*, as it will be in the case herein described, is produced by being built-up by a welding process and is rigidly connected to the base plate.

Figure 8:
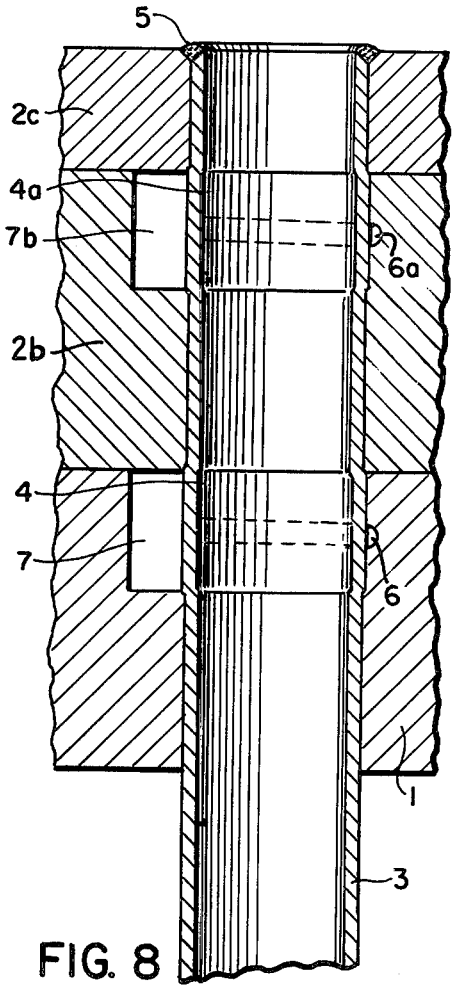
FIG. 8 is a vertical partial sectional view taken through a three-layered tube sheet assembly.

In accordance with FIG. 8, two cover plates 2*b*, 2*c* are arranged on top of the base plate 1. The tubes 3 extend through all three plates, the tubes being sealingly attached in base plate 1 and in the cover plate 2*b* in the middle by the rolling sections 4 or 4*a* and, at their ends, in the upper cover plate 2*c* by a welding seam 5. In the base plate 1, and in the cover plate 2*b* formed between the plate 1 and the cover 2*c*, annular grooves 6 and 6*a*, respectively are formed in the region of each of the tubes 3. These annular grooves 6, 6*a* are in communication with transverse ducts 7, 7*b*, respectively. The transverse ducts 7, 7*b*, in their planes corresponding to the embodiments according to FIGS. 1–3 or FIG. 4, lead to the exterior either immediately or through an annular duct or annular duct sections.

The advantage of a multilayered tube sheet assembly according to the present invention lies in the fact that, in the case of possible leaks between the tubes 3 and the tube sheet base plate 1 and/or the tube sheet cover plate 2*b*, both of the heat exchange media can be discharged to the exterior through the duct system. By arranging a suitable measuring device in each of the outlet type connections 10, 10*a*, 10*b*, 10*c*, 10*d* the leak may be detected immediately and the heat exchanger may be repaired after it has been taken out of operation. Thus, unrecognized or undetected large amounts of the heat exchange media are unlikely to come into contact with each other for extended periods of time and the aforementioned hazardous consequences are avoided or minimized.

From the embodiment shown in FIG. 8, there results a still further important effect in that, in the case of a leak in the vicinity of the rolled section 4, in the tube base plate 1, the heat exchange medium surrounding the tubes 3 is discharged through transverse ducts 7 arranged in the plane of the base plate while, in the case of a leak at the welding seam 5, the heat exchange medium which is passed through the tubes 3 may be discharged through transverse ducts 7*b* arranged in the plane of the tube sheet cover plate 2*b* which is located between the base plate and another cover plate 2*c*. Due to this separate discharge and, therefore, also due to the checking of the two heat exchange media, contact or mixing between the two media can be completely avoided and it may be immediately recognized where a leak is located.

On the other hand, in the embodiment according to FIGS. 3 and 4, it may be determined in which portion of a tube sheet a leak has occurred.

While specific embodiments of the invention have been shown and described in detail to illustrate the application of the inventive principles, it will be understood that the invention may be embodied otherwise without departing from such principles.

What is claimed is:

1. A multilayered tube sheet construction for heat exchangers, particularly those utilizing immiscible fluid heat exchange media, comprising a tube sheet base plate, a plurality of heat exchanger tubes extending along at least a portion of their length in sealed fluid-tight engagement through said tube sheet base plate, means defining within said base plate a series of internal ducts extending in flow communication with the exterior of said tubes in the vicinity of said portion of the length thereof in sealed engagement with said base plate, said tubes extending at their ends to project beyond said base plate, and a tube sheet cover plate extending over said tube sheet base plate and being rigidly connected thereto, said cover plate having said projecting ends of said tubes fixedly attached thereto, with said ducts being in flow communication with the exterior of said base plate to permit outflow therefrom of heat exchange media entering said ducts due to leakage, said tube sheet cover plate being produced by being built up by means of a welding process, said series of internal ducts having therein seals covering said ducts on the side thereof proximate said tube sheet cover plate.

2. A tube sheet construction according to claim 1 wherein said base plate has formed therein annular ducts sections in flow communication with said internal ducts, said seals being also provided in said annular duct sections.

3. A multilayered tube sheet construction for heat exchangers, particularly those utilizing immiscible fluid heat exchange media, comprising a tube sheet base plate, a plurality of heat exchanger tubes extending along at least a portion of their length in sealed fluid-tight engagement through said tube sheet base plate, said fluid-tight engagement between said portions of said tube length and said base plate being provided by a rolled-in section of said tubes connecting said tubes with said base plate, means defining within said base plate a series of internal ducts extending in flow communication with the exterior of said tubes in the vicinity of said portion of the length thereof in sealed engagement with said base plate, said tube sheet base plate in the regions thereof where said heat exchanger tubes extend in sealed engagement therewith having formed therein annular grooves, said series of internal ducts comprising transverse ducts connected to a group of said annular grooves and being in flow communication with the exterior of said base plate, said tubes extending at their ends to project beyond said base plate, and a tube sheet cover plate extending over said tube sheet base plate and being rigidly connected thereto, said cover plate having said projecting ends of said tubes fixedly attached thereto, with said ducts being in flow communication with the exterior of said base plate to permit outflow therefrom of heat exchange media entering said ducts due to leakage.

4. A multilayered tube sheet construction for heat exchangers, particularly those utilizing immiscible fluid heat exchange media, comprising a tube sheet base plate, a plurality of heat exchanger tubes extending along at least a portion of their length in sealed fluid-tight engagement through said tube sheet base plate, means defining within said base plate a series of internal ducts extending in flow communication with the exterior of said tubes in the vicinity of said portion of the length thereof in sealed engagement with said base plate, said tubes extending at their ends to project beyond said base plate, a first tube sheet cover plate extending over said tube sheet base plate and being rigidly connected thereto, said first cover plate having said projecting ends of said tubes fixedly attached thereto, with said ducts being in flow communication with the exterior of said base plate to permit outflow therefrom of heat exchange media entering said ducts due to leakage, and a second tube sheet cover plate provided between said first tube sheet cover plate and said tube sheet base plate arranged in immediate fixed engagement with said tube sheet cover and said tube sheet base plate, said plurality of heat exchange tubes being in sealed engagement with said second tube sheet cover plate over further portions of their length, said second tube sheet cover plate having formed therein a second corresponding series of internal ducts.

5. A tube sheet construction according to claim 4 including outlet pipe connections and outlet bores joining said internal ducts with the exterior of said base plate.

6. A tube sheet construction according to claim 4 wherein said tube sheet base plate, said tube sheet cover plate and said second tube sheet cover plate located between said base plate and said cover plate are rigidly interconnected with each other by spray deposition.

7. A tube sheet construction according to claim 6 wherein said second tube sheet cover plate has formed therein a second series of internal ducts, said tube sheet construction further including outlet bores and outlet pipe connections placing said second series of internal ducts in flow communication with the exterior of said second tube sheet cover plate.

8. A tube sheet construction according to claim 6 wherein said tube sheet base plate in the regions thereof where said heat exchanger tubes extend in sealed engagement therewith has formed therein annular grooves, said series of internal ducts comprising transverse ducts connected to a group of said annular grooves and being in flow communication with the exterior of said base plate.

9. A tube sheet construction according to claim 8 further comprising a plurality of annular duct sections each connected to a respective bore leading to the exterior of said base plate, said transverse ducts being in selective flow communication with said annular duct sections.

10. A tube sheet construction according to claim 8 wherein said transverse ducts are connected to a common annular duct formed in said base plate and to a bore leading to the exterior of said base plate through said annular duct.

* * * * *